US009676029B2

(12) United States Patent
Richaud

(10) Patent No.: US 9,676,029 B2
(45) **Date of Patent: *Jun. 13, 2017**

(54) SUBMERGED ENTRY NOZZLE

(71) Applicant: VESUVIUS CRUCIBLE COMPANY, Wilmington, DE (US)

(72) Inventor: Johan L. Richaud, Cheval Blanc (FR)

(73) Assignee: VESUVIUS CRUCIBLE COMPANY, Wilmington, DE (US)

( * ) Notice: Subject to any disclaimer, the term of this patent is extended or adjusted under 35 U.S.C. 154(b) by 4 days.

This patent is subject to a terminal disclaimer.

(21) Appl. No.: 14/821,240

(22) Filed: Aug. 7, 2015

(65) Prior Publication Data

US 2015/0343522 A1 Dec. 3, 2015

Related U.S. Application Data

(63) Continuation-in-part of application No. 13/806,914, filed as application No. PCT/US2011/036068 on May 11, 2011, now Pat. No. 9,120,148.

(60) Provisional application No. 61/361,265, filed on Jul. 2, 2010.

(51) Int. Cl.

| | |
|---|---|
| ***B22D 11/00*** | (2006.01) |
| ***B22D 35/00*** | (2006.01) |
| ***B22D 41/50*** | (2006.01) |

(52) U.S. Cl.

CPC ..... *B22D 41/507* (2013.01); *B22D 41/50* (2013.01)

(58) Field of Classification Search

CPC ..... B22D 41/50; B22D 41/507; B22D 41/56; B22D 41/54; B22D 41/58

USPC ..... 266/236; 222/591, 606, 607, 594; 164/133, 488, 337, 437

See application file for complete search history.

(56) References Cited

U.S. PATENT DOCUMENTS

| | | | | |
|---|---|---|---|---|
| 3,517,726 | A * | 6/1970 | Halley | B22D 41/50 164/134 |
| 3,934,638 | A * | 1/1976 | Joseph | B22D 41/50 164/489 |
| 4,949,778 | A | 8/1990 | Saito et al. | |
| 6,016,941 | A | 1/2000 | Damle | |
| 8,037,924 | B2 | 10/2011 | Kido et al. | |
| 9,120,148 | B2 * | 9/2015 | Richaud | B22D 41/50 |
| 2005/0127582 | A1 | 6/2005 | Richaud et al. | |
| 2006/0169728 | A1 | 8/2006 | Xu et al. | |

(Continued)

FOREIGN PATENT DOCUMENTS

| | | | |
|---|---|---|---|
| AU | 4778472 | A | 4/1974 |
| CN | 201385125 | Y | 1/2010 |
| CN | 101733375 | A | 6/2010 |

(Continued)

*Primary Examiner* — Roy King
*Assistant Examiner* — Michael Aboagye
(74) *Attorney, Agent, or Firm* — Thomas Clinton; Donald M. Satina

(57) ABSTRACT

A pour tube for casting molten metal is adapted to reduce turbulence and mold disturbances, thereby producing a more stable, uniform outflow. The pour tube has a central longitudinal axis and includes a bore in communication with a port distributor having a greater radius with respect to the longitudinal axis than does the bore. Exit ports provide fluid communication between the port distributor and the exterior of the device. Each of a pair of larger exit ports has a larger cross-sectional area than does either of a pair of smaller exit ports.

16 Claims, 10 Drawing Sheets

(56) References Cited

U.S. PATENT DOCUMENTS

| | | | |
|---|---|---|---|
| 2007/0158884 | A1 | 7/2007 | Tsukaguchi |
| 2009/0288799 | A1 | 11/2009 | Miyazaki et al. |

FOREIGN PATENT DOCUMENTS

| | | | | |
|---|---|---|---|---|
| GB | 2444805 | A | | 6/2008 |
| JP | 4846534 | A | | 7/1973 |
| JP | 551497853 | | * | 10/1980 |
| JP | 55149753 | A | | 11/1980 |
| JP | 56148453 | A | | 11/1981 |
| JP | 58112641 | | * | 7/1983 |
| JP | 58112641 | A | | 7/1983 |
| JP | 08294757 | A | | 11/1996 |
| RU | 2204461 | C1 | | 5/2003 |
| RU | 2379154 | C2 | | 1/2010 |

* cited by examiner

SUBMERGED ENTRY NOZZLE

CROSS-REFERENCING TO RELATED APPLICATIONS

This application is a continuation-in-part of U.S. application Ser. No. 13/806,914, filed on Dec. 26, 2012, now U.S. Pat. No. 9,120,148, which is a 371 of international application PCT/US2011/036068, filed May 11, 2011, which claims the benefit of provisional application U.S. Application Ser. No. 61/361,265 filed on Jul. 2, 2010.

FIELD OF THE INVENTION

This invention relates generally to a refractory article and, more particularly, to a refractory pour tube for use in the transfer of molten metal in a continuous casting operation.

BACKGROUND

In the continuous casting of metal, particularly steel, a stream of molten metal is typically transferred via a refractory pour tube from a first metallurgical vessel into a second metallurgical vessel or mold. Such tubes are commonly referred to as nozzles or shrouds and possess a bore adapted to transfer molten metal. Pour tubes include submerged-entry nozzles (SEN) or submerged-entry shrouds (SES), which discharge molten metal below the liquid surface of a receiving vessel or mold.

Liquid metal is discharged from the downstream end of the bore through one or more outlet ports. One important function of a pour tube is to discharge the molten metal in a smooth and steady manner without interruption or disruption. A smooth, steady discharge facilitates processing and can improve the quality of the finished product. A second important function of a pour tube is to establish proper dynamic conditions within the liquid metal in the receiving vessel or mold in order to facilitate further processing. Producing proper dynamic conditions may require the pour tube to possess a plurality of exit ports that are arranged so as to cause the stream of molten metal to be turned in one or more directions upon discharge from the tube.

It may be desirable, for a number of reasons, to induce rotational flow within the mold into which the molten metal is being discharged. Rotation of the flow increases the residence time inside the mold liquid pool to enhance the flotation of inclusions. Rotation of the flow also produces temperature homogenization, and reduces the growth of dendrites along the steel solidifying front. Rotation of the flow also reduces the mixing of steel grades when consecutive grades of steel flow through the pour tube without interruption.

Various technologies have been used in attempts to provide rotation of the flow. Electromagnetic stirring devices may be placed below the entry nozzle. Entry nozzles have been designed that can be rotated in use. Entry nozzles have also been designed with curved exit ports tangent to the bore of the tube.

Various disadvantages are seen in the prior art technology. Electromagnetic stirring devices have a limited life in a hostile environment, rotation of entry nozzle permits oxygen to come in contact with molten metal stream, and curved exit ports are not successful in inducing rotational flow in all mold configurations.

DE1802884 discloses a rotating feed pipe for steel bar casting. However, the device lacks a port distributor having a greater radius with respect to the horizontal axis than does the bore.

FR2156373 discloses processes and equipment for the rotary casting of molten metal. However, the equipment lacks a port distributor having a greater radius with respect to the horizontal axis than does the bore.

FR2521886 discloses a process and a device to place in rotation, in an ingot mold, continuous-cast molten metal. However, the device lacks a port distributor having a greater radius with respect to the horizontal axis than does the bore.

GB2198376 discloses an immersion tube for continuous casting. However, the tube lacks a port distributor having a greater radius with respect to the horizontal axis than does the bore.

JP6227026 discloses a submerged nozzle for a continuous casting apparatus. However, the nozzle lacks a port distributor having a greater radius with respect to the horizontal axis than does the bore.

RU2236326 discloses a method for continuous casting of steel from an intermediate ladle to a mold, and a submersible nozzle for performing the method. However, the nozzle lacks a port distributor having a greater radius with respect to the horizontal axis than does the bore.

SU1565573 discloses an arrangement for stirring molten metal in continuous casting. However, the device lacks a port distributor having a greater radius with respect to the horizontal axis than does the bore.

A need persists for a refractory pour tube that produces rotational flow in a variety of mold configurations without the use of additional electromechanical devices. Ideally, such a tube would also improve the flow of molten metal into a casting mold and improve the properties of the cast metal.

SUMMARY OF THE INVENTION

The present invention relates to a pour tube for use in the casting of molten metal. The pour tube includes at least two exit ports and, relative to prior art, provides a more effective rotational flow inside the molds into which molten material flows from the pour tube. Rotation of the flow increases the residence time inside the liquid mold pool to produce better flotation of inclusions, reduces the growth of dendrites formed along the steel solidifying front, and allows a significant reduction of steel grade mixing when consecutive grades of steel are passing through the pour tube without interruption. Particular configurations of rotational flow can also reduce competing surface flows that induce high turbulence levels. The production of a rotating flow by the present invention provides a replacement for the use of electromagnetic stirring of the contents of the mold to provide thermal homogeneity and optimal mold powder melting. These benefits can result in an improved finished product.

Pour tubes of the present invention also provide improved mold flow behavior with optimal hot steel distribution to promote uniform steel formation, improved mold powder melting with a hotter meniscus for enhanced lubrication, improved mold level, and flow rotation to prevent carbon segregation during cooling. Specific configurations of pour tubes of the present invention provide improved flow stirring in rectangular blooms with an aspect ratio (width/thickness) of 1.2 or greater, and a thickness greater than 200 mm.

In a broad aspect, the article comprises a pour tube having an enlarged port distributor in direct fluid communication with exit ports. The exit ports are disposed around the port distributor at specific angles, configurations and in specific relative dimensions to produce rotational flow.

In one aspect, the article of the invention comprises a pour tube for use in casting a stream of molten metal from an upstream position to a downstream position, the pour tube having a pour tube central longitudinal axis and comprising an inner surface defining a bore and a port distributor in fluid communication, and an outer surface comprising a first pair of larger exit ports and comprising a pair of smaller exit ports, wherein the larger exit ports and the smaller exit ports are in fluid communication with the port distributor, wherein the port distributor is located downstream of the bore, and wherein the port distributor has a greater radius with respect to the longitudinal axis than does the bore. In this embodiment, each port may have a straight central longitudinal axis, and the exit port central longitudinal axes do not intersect the pour tube longitudinal axis. In this embodiment, the exit ports may comprise an inner wall and an outer wall, each in communication with the port distributor and the outer surface, and the outer wall has a greater length than the inner wall. In this embodiment, one or more of the exit ports, defined as smaller exit ports, may have a smaller cross-sectional area in a vertical plane than the remaining exit ports, defined as larger exit ports. The exit port cross-sectional area may be defined as the cross-sectional area of the exit port at its intersection with the port distributor. A pour tube of the invention may be configured with a pair of exit ports, with each port of the pair of exit ports having a smaller cross-section area than the remaining exit ports, with each port of the pair of exit ports having a smaller cross-section area than the remaining exit ports being disposed in an opposite position or position represented by 180 degrees of rotation, with respect to the other exit port of the pair, on the horizontal circumference of the exterior of the pour tube. The device may further comprise a second pair of larger exit ports. For example, a six-exit-port pour tube configured for use in a narrow refractory vessel may be configured with two pairs of exit ports with larger cross-section areas and one pair of exit ports with smaller cross-section areas, the individual ports in each pair being disposed in opposite positions around the horizontal circumference of the exterior of the pour tube.

In another aspect, the invention includes exit ports that comprise an inner wall in communication with the port distributor and the outer surface of the pour tube, and an outer wall in communication with the port distributor and the outer surface of the pour tube. The outer wall and the inner wall may be entirely vertical, may contain vertical portions, or may be configured at a smaller angle to the vertical than other surfaces of the exit ports. The outer wall has a greater length in the horizontal plane than does the inner wall. The outer walls of the exit ports, or horizontal projections of the outer walls of the exit ports, do not intersect the bore, or do not intersect a vertical projection of the bore. In certain embodiments, the outer walls of the exit ports are tangent to a circle that is concentric with the bore and has a greater radius than the bore, or are tangent to the port distributor. In certain embodiments, the exit ports are externally unobstructed; there is no portion of the article of the invention wherein the portion is disposed exterior to an exit port, and wherein the portion is intersected by an externally directed projection of a cross-section of the exit port. Certain embodiments of the invention are characterized by the absence of a bottom hole connecting the port distributor and a pour tube bottom surface. Certain embodiments of the invention are characterized by ports through which a straight line may pass from the port distributor to the outer wall of the flow tube. Certain embodiments of the invention are characterized by the absence of a rotating component. In certain embodiments of the invention, the longitudinal axes of the exit ports do not intersect the pour tube central longitudinal axis.

In an embodiment of the invention, the exit ports are spaced regularly at a rotation angle theta around the periphery of the port distributor, and the exit ports have a port width of at least $2r_{pd}\sin(\text{theta}/2)^2$, wherein $r_{pd}$ is the port distributor radius and theta is the rotation angle around the periphery of the port distributor occupied by the port, expressed in radians.

In another embodiment of the invention, the exit ports are configured so that $4\pi r_b > n r_{pd}(\text{theta}) > 1.3\pi r_b$, wherein $r_b$ is the bore radius, n is the number of exit ports, $r_{pd}$ is the port distributor radius, and theta is the rotation angle around the periphery of the port distributor occupied by the port, expressed in radians.

In another embodiment of the invention, the exit ports have a nonzero flare angle in the horizontal plane that is equal to or less than theta/2.

In another embodiment of the invention, the exit ports are configured so that $3\pi r_b^2 > hna > 0.5\pi r_b^2$, wherein $r_b$ is the bore radius, h is the exit port height, n is the number of exit ports, and a is the width of the port entrance. In terms of absolute values, an embodiment of the invention makes use of exit ports having an exit port height equal to or greater than 8 mm to facilitate manufacturing of the pour tube of the invention, and to expedite liquid metal castability.

In a further embodiment of the invention, the exit ports are configured so that the maximum angle theta around the periphery of the port distributor occupied by an exit port is $\arccos(r_{pd}/r_{ex})$, and so that $a < r_{pd}((r_{ex}-r_{pd})/r_{ex})$, where a is the width of the port entrance, $r_{pd}$ is the port distributor radius and $r_{ex}$ is the pour tube radius in the horizontal plane of the port distributor. In terms of absolute values, an embodiment of the invention makes use of exit ports having an exit port width equal to or greater than 8 mm to facilitate manufacturing of the pour tube of the invention, and to expedite liquid metal castability.

Design elements of the present invention, including non-intersection of the longitudinal axes of the exit ports with the pour tube central longitudinal axis, the number and relative sizes of exit ports, port distributor size and configuration, port wall height, port wall width, port cross-section area, port wall flare angle, and the absence of a straight line from the vertical axis of the port distributor through the port to the exterior of the pour tube, lead to swirling of the fluid around an exit port axis as it flows outward through the exit port. The jet momentum of fluid passing through the exit ports of a pour tube of the present invention is reduced, as is the strength of the jets coming in contact with a mold wall. Prior art pour tubes exhibit an increase in fluid velocity between the inlet and the exit port; in the present invention, this increase is minimized or, in some cases, reduced. Pour tubes of the present invention produce curved fluid paths both within and outside the exit port. Pour tubes of the present invention with four ports and six ports produce a swirling velocity that is uniform and evenly distributed. The swirling may take the form of a spiral of helical flow with the port axis as its axis. The reduction of jet momentum enables the pour tube of the present invention to be configured and used without a skirt or shield disposed external to, and in the horizontal plane of, the ports. Designs of the device of the present invention may incorporate a plurality of exit port cross-section areas, so that exit ports exhibit corresponding differences in exit port jet momentum values. Exit ports having different cross-section areas can be disposed around the circumference of the exterior of the device so that exit ports closer to a wall of the vessel in which the device is contained will have a reduced cross-section area. A device of the invention may be configured with larger exit ports and smaller exit ports, so that each of a pair of larger exit ports has a larger cross-sectional area than does either of a pair of smaller exit ports. A device of the invention may be configured with a pair of exit ports, with each exit port of the pair of exit ports having a smaller cross-section area than the remaining exit ports, with each exit port of the pair of exit ports having a smaller cross-section area than the remaining exit ports being disposed in opposite positions with respect to the other on the horizontal circumference of the exterior of the device. For example, a six-exit-port device configured for use in a narrow refractory vessel may be configured with two pairs of exit ports with larger cross-section areas and one pair of exit ports with smaller cross-section areas, with each exit port in each pair being disposed in an opposite position with respect to the other exit port around the horizontal circumference of the exterior of the device.

Other details, objects and advantages of the invention will become apparent through the following description of a present preferred method of practicing the invention.

DETAILED DESCRIPTION OF INVENTION

The invention comprises a pour tube for use in the continuous casting of molten metal. The pour tube comprises a bore fluidly connected to at least two exit ports. Pour tube means shrouds, nozzles, and other refractory pieces for directing a stream of molten metal, including, for example, submerged entry shrouds and nozzles. The invention is particularly suited for pour tubes having an exit port adapted to deliver molten metal below the surface of the metal in a receiving vessel such as a mold.

Figure 1:
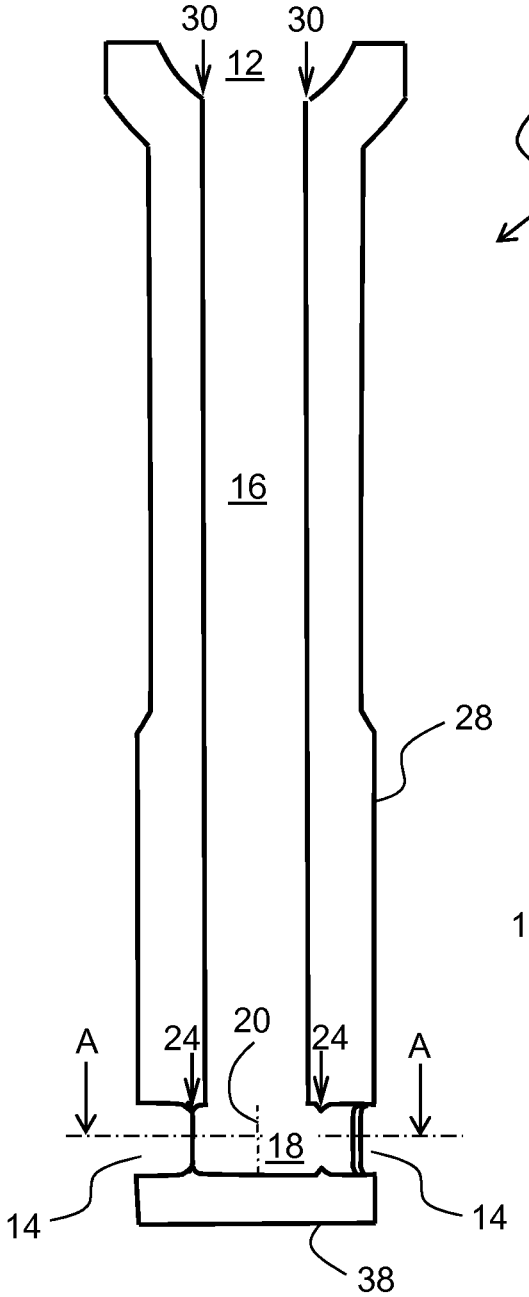
FIG. 1 shows a sectional view, along a vertical plane, of an embodiment of a pour tube of the current invention.

FIG. 1 shows a view, along a vertical section, of a pour tube 10. The pour tube 10 comprises an inlet 12 and an exit port 14 fluidly connected by a bore 16 and a port distributor 18. The pour tube 10 permits a stream of molten metal to pass from an upstream end at the inlet 12, through the bore and to a downstream end at the port distributor 18, the port distributor 18 having a vertical axis 20 and a radial extent 24, and thence to exit port 14. The exit port 14 is defined by the perimeter of a hole that extends through the pour tube 10 to pour tube outer surface 28 from port distributor radial extent 24 of port distributor 18. The perimeter of the exit port may be of any convenient general shape including, but not limited to, oval, polygonal or any combination thereof. Conveniently, the general shape of the exit port is substantially rectangular, and may be rectangular with corners having a radius of curvature. In the case of an exit port with a substantially rectangular shape, the exit port may have exit port walls, an exit port upper surface proximal to the upstream end of the pour tube, and an exit port lower surface proximal to the downstream end of the pour tube. The exit port walls connect the exit port upper surface to the exit port lower surface. Individual embodiments of the invention may have exit port walls that may be described by straight lines not parallel to the longitudinal or vertical axis 20. Bore 16 has, in this embodiment, a bore radial extent 30 that is less than port distributor radial extent 24 and, more specifically, a bore radial extent 30 that is, for the entire length of the bore, less than port distributor radial extent 24. In certain embodiments of the invention, a port collector basin extends downwardly from, and is in fluid communication with, port distributor 18. In an alternate embodiment of the invention, a bottom hole connects the port distributor 18 to a pour tube bottom surface 38.

Figure 2:
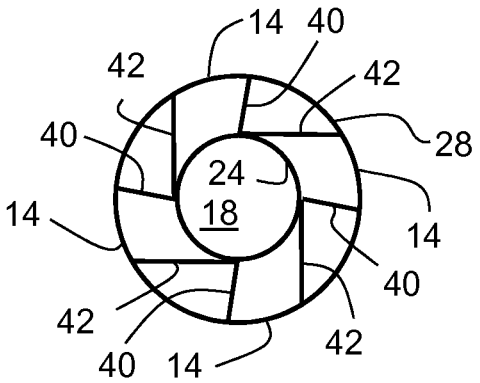
FIG. 2 shows a sectional view, along a horizontal plane, of an embodiment of a pour tube of the present invention.

FIG. 2 shows a sectional view, along section line A-A of FIG. 1, of the embodiment of a pour tube of the present invention shown in FIG. 1. Four exit ports 14 fluidly connect port distributor 18 to the outer surface 28 of pour tube 10. Each exit port 14 in this embodiment has an inner exit port wall 40 and an outer exit port wall 42 partially defining the exit port. Outer exit port wall 42 has a greater length in a horizontal plane orthogonal to vertical axis 20 than does inner exit port wall 40. The radial extent of the port distributor 24 is greater than the radial extent 30 of the bore. At least one outer exit port wall 42 is tangent to a circle that has a radial extent greater than the radial extent of the inner bore wall. In the embodiment shown, each exit port wall 42 is tangent to a circle that has a greater radius than the radius of inner bore wall and, in this embodiment, each exit port wall 42 is tangent to the circle defined by the radial extent 24 of port distributor 18. Each exit port 14 in this embodiment has a flare; the cross-sectional area of each port at the extent 24 of the port distributor is smaller than the cross sectional area of the port at the outer surface 28 of the pour tube.

Figure 3:
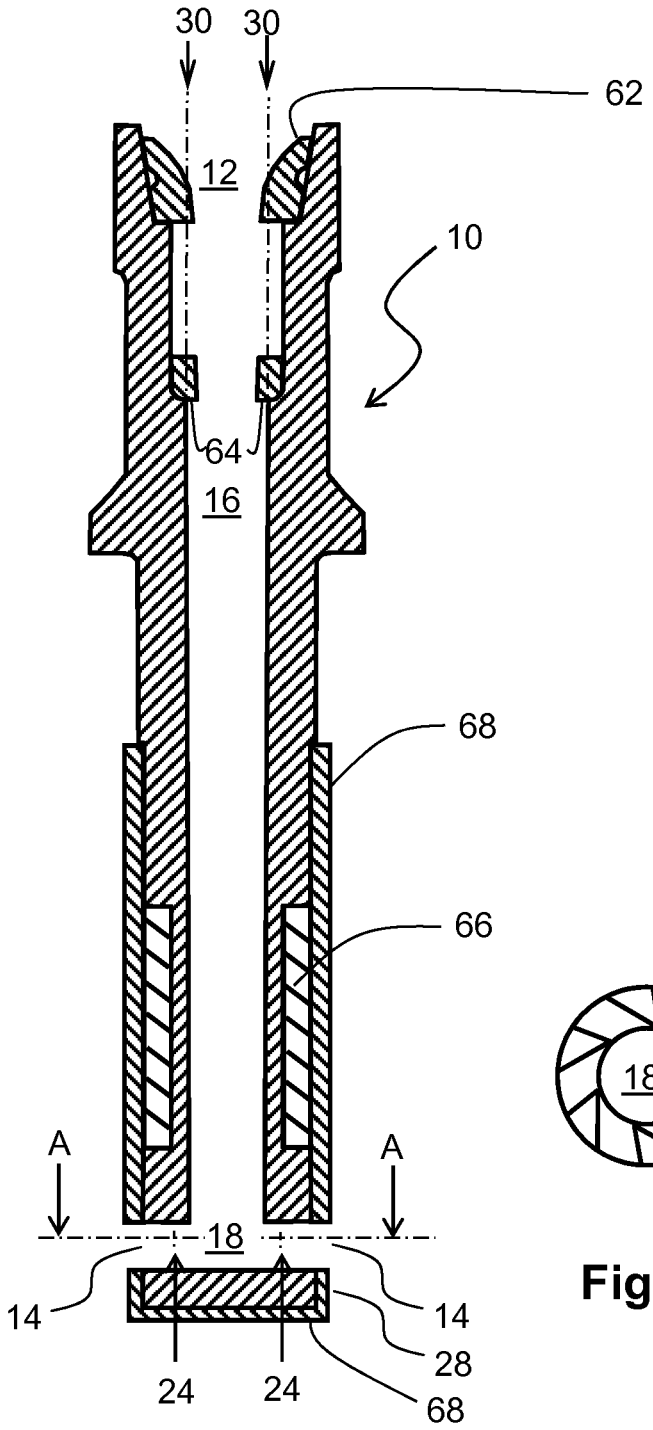
FIG. 3 shows a sectional view, along a vertical plane, of an embodiment of a pour tube of the current invention.

FIG. 3 shows a view, along a vertical section, of a pour tube 10. The pour tube 10 comprises an inlet 12 and an exit port 14 fluidly connected by a bore 16 and a port distributor 18. The pour tube 10 permits a stream of molten metal to pass from an upstream end at the inlet 12, through the bore and to a downstream end at the port distributor 18, the port distributor 18 having a radial extent 24, and thence to exit port 14. The exit port 14 is defined by the perimeter of a hole that extends through the pour tube 10 to pour tube outer surface 28 from port distributor radial extent 24 of port distributor 18. The perimeter of the exit port may be of any convenient general shape including, but not limited to, oval, polygonal or any combination thereof. Conveniently, the general shape of the exit port is substantially rectangular, and may be rectangular with corners having a radius of curvature. In the case of an exit port with a substantially rectangular shape, the exit port may have exit port walls, an exit port upper surface proximal to the upstream end of the pour tube, and an exit port lower surface proximal to the downstream end of the pour tube. The exit port walls connect the exit port upper surface to the exit port lower surface. Seat insert 62, located within the bore at inlet 12, permits the bore tube to be fitted to a vessel above the pour tube. Seat insert 62 may be formed, for example, from a refractory material such as zirconia. Lower seat insert 64, located within the bore below seat insert 62, also performs seating functions. Lower seat insert 64 may be formed, for example, from a refractory material such as zirconia. Slag line sleeve 66, located circumferentially around the exterior of pour tube 10, enables the pour tube to withstand mechanical and chemical stresses produced at the slag line. Slag line sleeve 66 may be formed, for example, from a refractory material such as zirconia. Insulating fiber 68, located on the exterior of a lower portion of the pour tube, protects exterior of the pour tube. Insulating fiber 68 may be formed from fibers of a refractory material.

Figure 4:
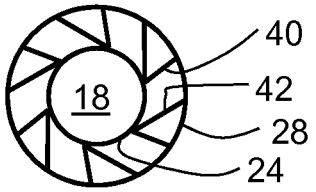
FIG. 4 shows a sectional view, along a horizontal plane, of an embodiment of a pour tube of the present invention.

FIG. 4 shows a sectional view, along section line A-A of FIG. 3, of the embodiment of a pour tube of the present invention shown in FIG. 3. Six exit ports 14 fluidly connect port distributor 18 to the outer surface 28 of pour tube 10. Each exit port 14 in this embodiment has an inner exit port wall 40 and an outer exit port wall 42 partially defining the exit port. Outer exit port 42 has a greater length in the horizontal plane than does inner exit port 40. The radial extent 24 of the port distributor 18 is greater than the radial extent 30 of the bore. At least one outer exit port wall 42 is tangent to a circle that has a greater radius than the radius of inner bore wall 30. In the embodiment shown, each exit port wall 42 is tangent to a circle that has a greater radius than the radius of inner bore wall 30 and, in this embodiment, each exit port wall 42 is tangent to the circle defined by the radial extent 24 of port distributor 18. Each exit port 14 in this embodiment has a flare; the cross-sectional area of each port at the extent 24 of the port distributor is smaller than the cross sectional area of the port at the outer surface 28 of the pour tube.

Figure 5:
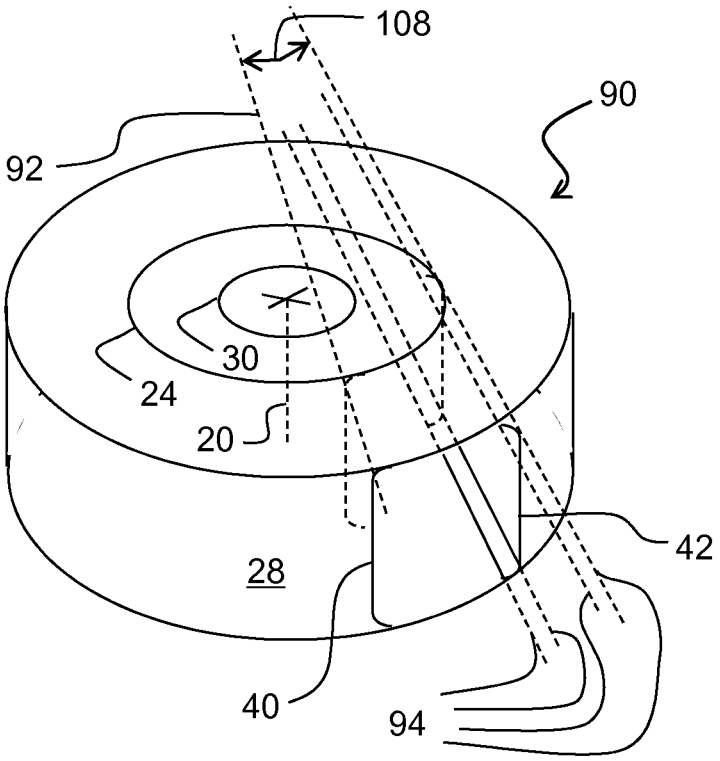
FIG. 5 shows a perspective diagram of a portion of an embodiment of a pour tube of the present invention.

FIG. 5 shows a perspective diagram of a portion 90 of an embodiment of a pour tube of the present invention. The diagram depicts the port distributor and the horizontally adjacent portions of the pour tube. The lower end of the bore meets the upper end of the port distributor; the surface shown between radial extent 24 of the port distributor and radial extent 30 of the bore wall represents the upper surface of the port distributor. The portion of the pour tube between the extent 24 of the port distributor and the outer surface 16 houses the exit ports. A single exit port is shown, with inner port wall 40 and outer port wall 42. A single projection line 92 is shown for inner exit port wall 40; this projection line is tangent to a circle coaxial to the port distributor that has a radial extent that is less than the radial extent 30 of the bore. Horizontal projection lines 94 are shown for outer port wall 42. The plane of outer port wall 42 is tangent to a circle coaxial to the port distributor that has a greater radius than the radius of inner bore wall 30. In the embodiment shown, the plane of outer port wall 42 is tangent to a circle that has the same radius as the radial extent 24 of the port distributor. Port flare angle 108 is the angle between the inner port wall 40 and outer port wall 42. Projections of the inner port walls 40 do not intersect the axis 20 of the port distributor.

Figure 6:
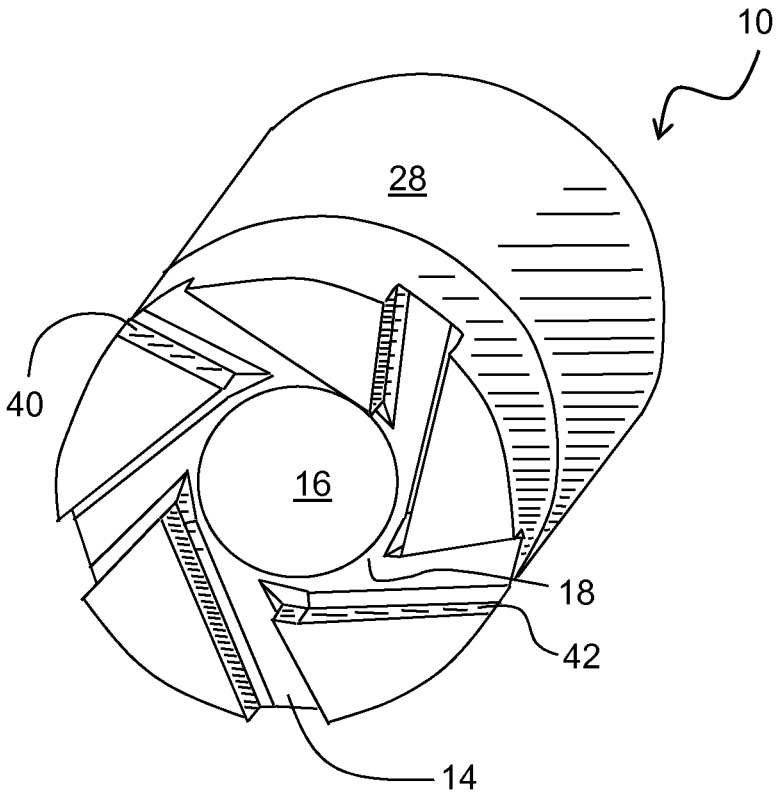
FIG. 6 shows a perspective view of an embodiment of a pour tube of the present invention sectioned along a plane passing horizontally through the port distributor.

FIG. 6 shows a perspective view of an embodiment of a pour tube 10 of the present invention sectioned along a plane passing horizontally through the port distributor. Bore 16 is in fluid communication with port distributor 18. Each of five exit ports 14 has an inner exit port wall 40 and an outer exit port wall 42 partially defining the exit port. Outer exit port walls 42 are tangent to a circle that is larger than the bore diameter above the ports; this configuration is referred to as an offset configuration.

Figure 7:
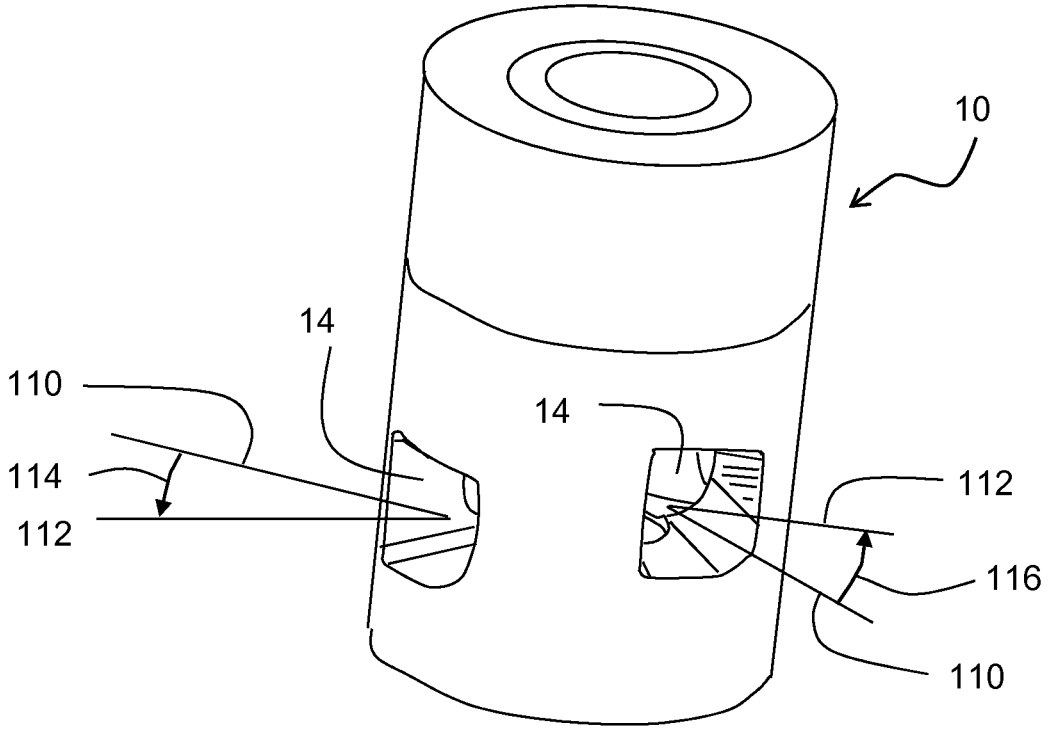
FIG. 7 shows a side perspective view of an embodiment of a pour tube of the present invention.

FIG. 7 shows a side perspective view of an embodiment of a pour tube 10 of the present invention. In this embodiment, exit ports 14 are configured so that exit port upstream surfaces and exit port downstream surfaces are not in the horizontal plane. The axis of each port is shifted from horizontal direction 110. The port axis 112 may be shifted by an angle 114 below the horizontal, or by an angle 116 above the horizontal. In certain embodiments the pour tube has a plurality of exit ports with at least one port around the periphery of the pour tube having an axis directed above the horizontal plane, and with at least one port around the periphery of the pour tube having an axis directed below the horizontal plane. In certain embodiments, the pour tube has an even number of ports, and consecutive ports around the periphery of the pour tube have axes that are alternately shifted upwards and downwards. In other embodiments, the pour tube has an even number of ports, and consecutive ports around the periphery of the pour tube have axes that are alternately horizontal and shifted downwards. A particular embodiment of the invention may have four lateral ports, oriented at 90-degree intervals around the periphery of the pour tube. Each port in this embodiment has a flare of 2 degrees to improve jet diffusion from the port. Two ports have a downward angle of 15 degrees and the other two ports have an upward angle of 5 degrees. In various embodiments of the invention, ports may have flares of 2, 3, 4, 5, 6, 7, 8, 9, 10, 11, 12, 13, 14 or 15 degrees, flares in the ranges from 1 degree to 15 degrees, 1 degree to 12 degrees, 2 degrees to 10 degrees, 2 degrees to 8 degrees, or a positive value of at most theta/2, where theta is the rotation angle around the periphery of the port distributor occupied by the port, expressed in radians.

Figure 8:
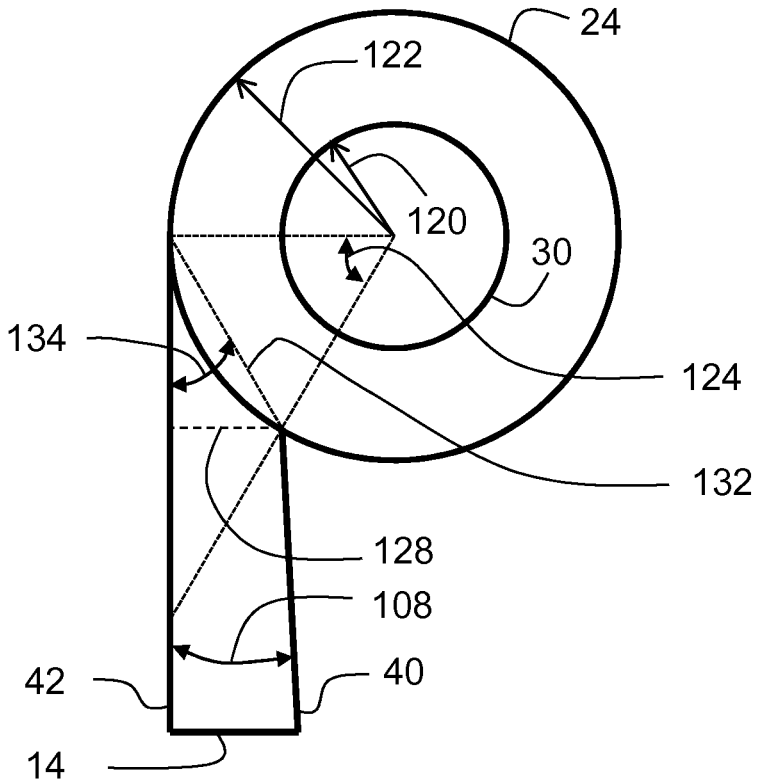
FIG. 8 shows a diagram of the terminology used to describe the geometry of the distributor port and exit ports of a pour tube of the present invention.

FIG. 8 is a diagram, in the horizontal plane, of various geometrical elements of an embodiment of a pour tube of the present invention. A circle represents the radial extent 24 of the port distributor. Another circle represents the radial extent 30 of the bore. Bore radius 120 represents the distance from the center of the bore to the radial extent 30 of the bore. Port distributor radius 122 represents the distance from the center of the port distributor to the radial extent 24 of the port distributor. Rotation angle 124, also designated by the symbol theta, represents the angle around the periphery of the port distributor that is occupied by an individual port. Port width 128, perpendicular to the axis of an exit port 14, at the point of contact of the port with the port distributor, is also designated by the letter a. The flare angle 108 of the opening port in the horizontal plane represents the angle between an inner port wall 40 and an outer port wall 42, and is also designated by the symbol gamma. Port entrance line 132 represents the distance between the inner port wall-port distributor intersection and outer port wall-port distributor intersection for a given port. Port exit angle 134 represents the angle between the port entrance line 132 and outer port wall 42.

Figure 9:
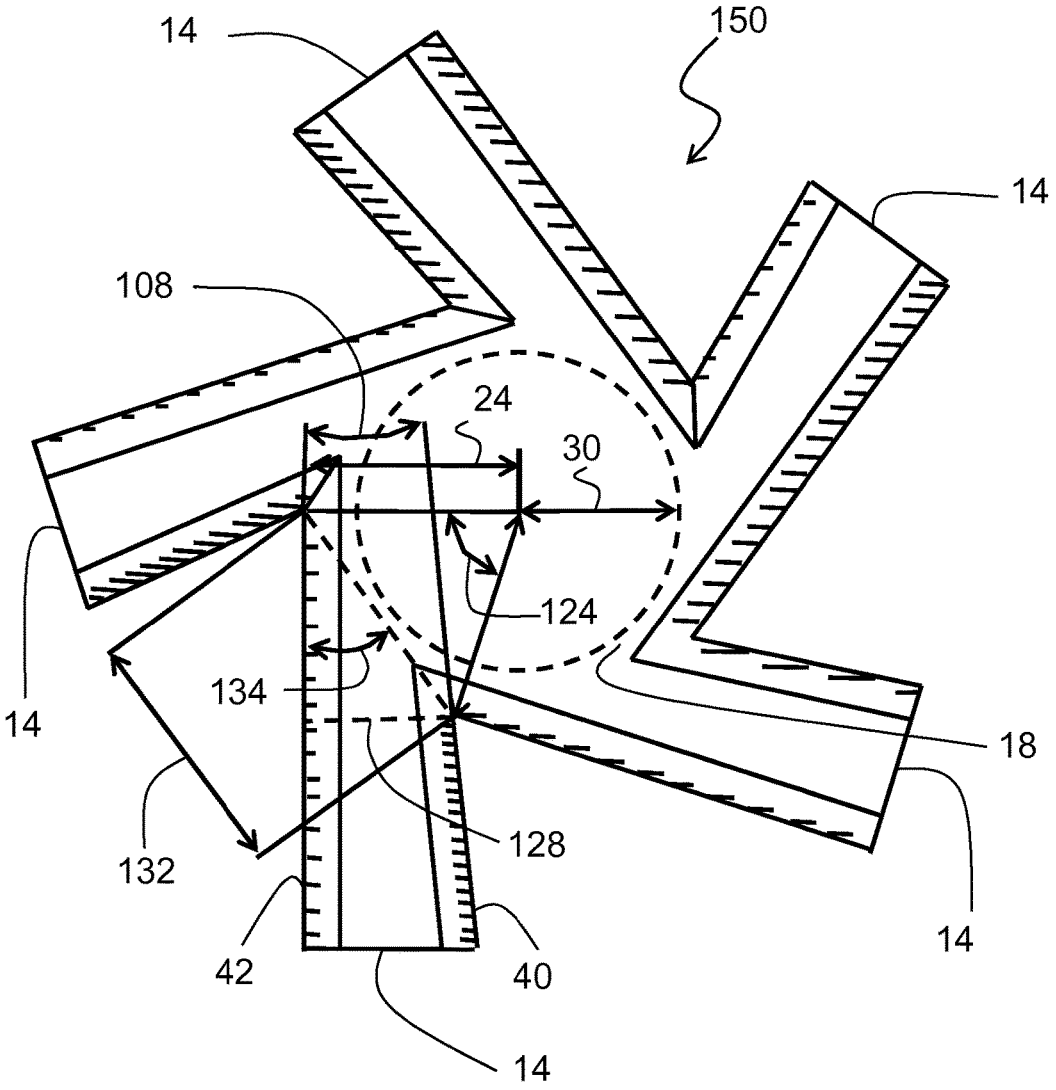
FIG. 9 shows a perspective view, from the bottom, of the inner walls of a distributor port of an embodiment of a pour tube of the present invention.

FIG. 9 is a bottom view of the inner walls of a flow assembly 150 of a port distributor 18 and five exit ports 14 contained in an embodiment of a flow tube of the present invention. The port distributor has a port distributor radial extent 24, which is greater than bore radial extent 30. The flare angle 108 of the opening port in the horizontal plane is designated by the symbol gamma. Rotation angle 124, designated by the symbol theta, represents the angle around the periphery of the port distributor that is occupied by an individual port. Port width 128, perpendicular to the axis of the port, at the point of contact of the port with the port distributor, is designated by the letter a. The flare angle 108 of the opening port in the horizontal plane is designated by the symbol gamma. Port entrance line 132 represents the distance between the inner port wall-port distributor intersection and outer port wall-port distributor intersection for a given port having an inner port wall 40 and an outer port wall 42. Port exit angle 134 represents the angle between the port entrance line 132 and outer port wall 42.

Figure 10:
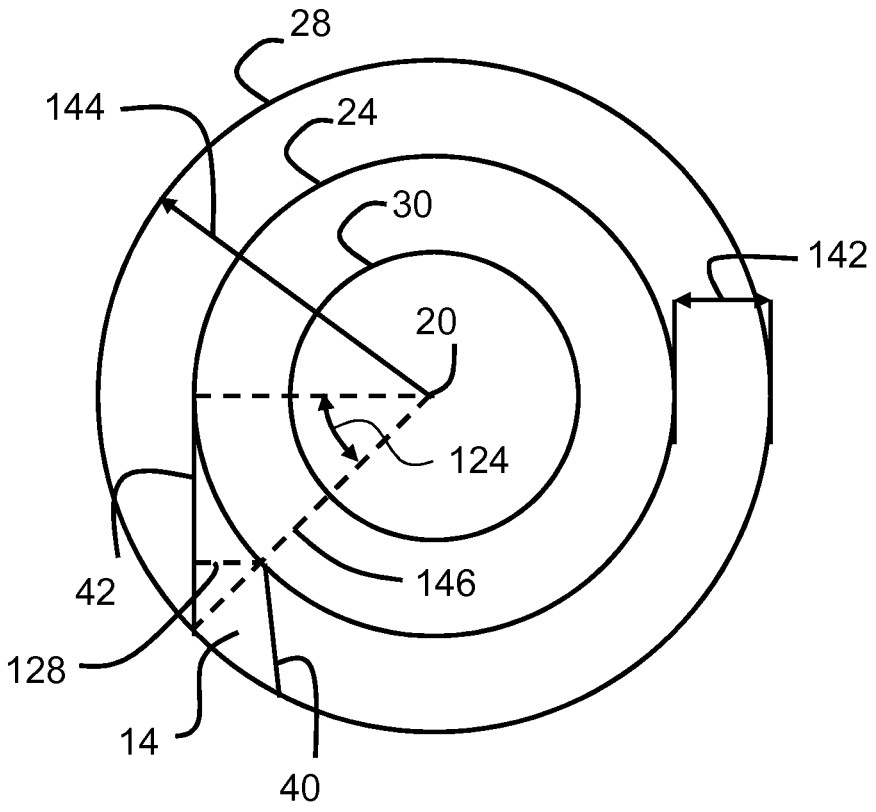
FIG. 10 shows a diagram of the terminology used to describe the geometry of the distributor port and exit ports of a pour tube of the present invention.

FIG. 10 is a diagram, in the horizontal plane, of various geometrical elements of an embodiment of a pour tube of the present invention. A circle represents the radial extent 24 of the port distributor. Another circle represents the radial extent 30 of the bore. A circle surrounding the radial extent of the bore and the radial extent of the port distributor represents the outer surface 28 of the pour tube. The vertical axis of the port distributor 20 intersects the horizontal plane of this representation. Exit port 14 is partly described by inner exit port wall 40 and outer exit port wall 42. Rotation angle 124, designated by the symbol theta, represents the angle around the periphery of the port distributor that is occupied by an individual port. The wall thickness 142 of the pouring tube around the port distributor is represented by the distance between the radial extent of the port distributor 24 and the outer surface 28 of the pour tube. Port distributor exterior radius 144 represents the distance between the vertical axis of the port distributor 20 and the exterior surface 28 of the pour tube in a horizontal plane of the port distributor. Exit line 146 represents a radial line, in the horizontal plane, from the vertical axis of the port distributor. For certain embodiments of the present invention, all exit lines emanating in a horizontal plane from the vertical axis 20 of the port distributor intersect an exit port wall before they reach the exterior surface 28 of the pour tube.

Figure 11:
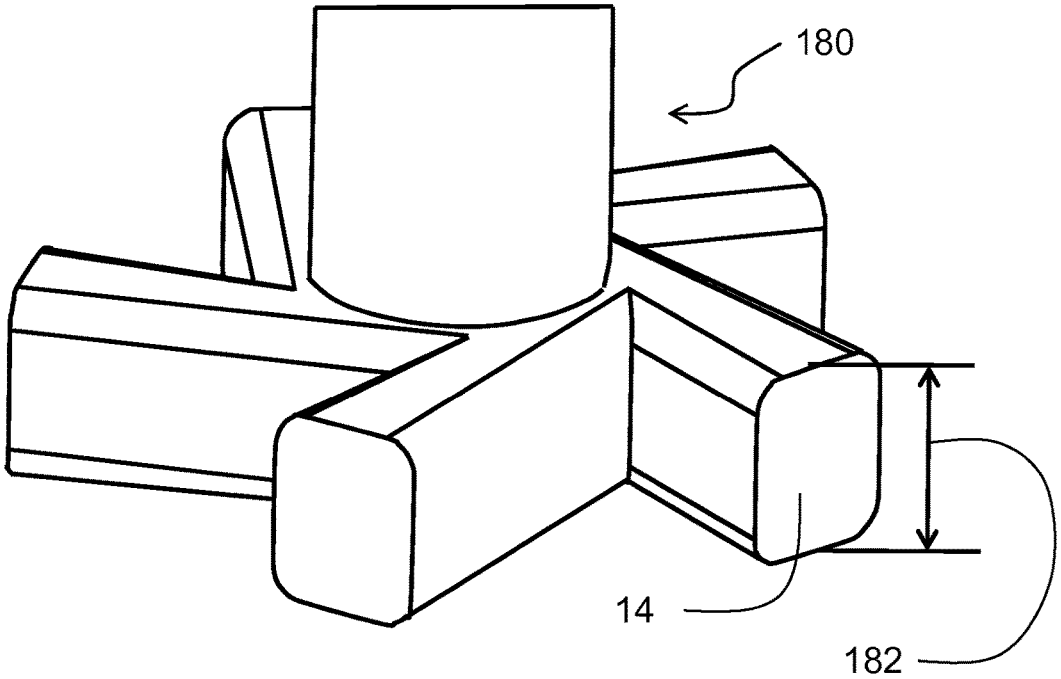
FIG. 11 shows a side perspective view of the inside surfaces of a distributor port of an embodiment of a pour tube of the present invention.

FIG. 11 is a side elevation perspective view of the inner walls of a flow assembly 180 of a port distributor and five exit ports contained in an embodiment of a flow tube of the present invention. A port height 182 is shown for an exit port 14.

Figure 12:
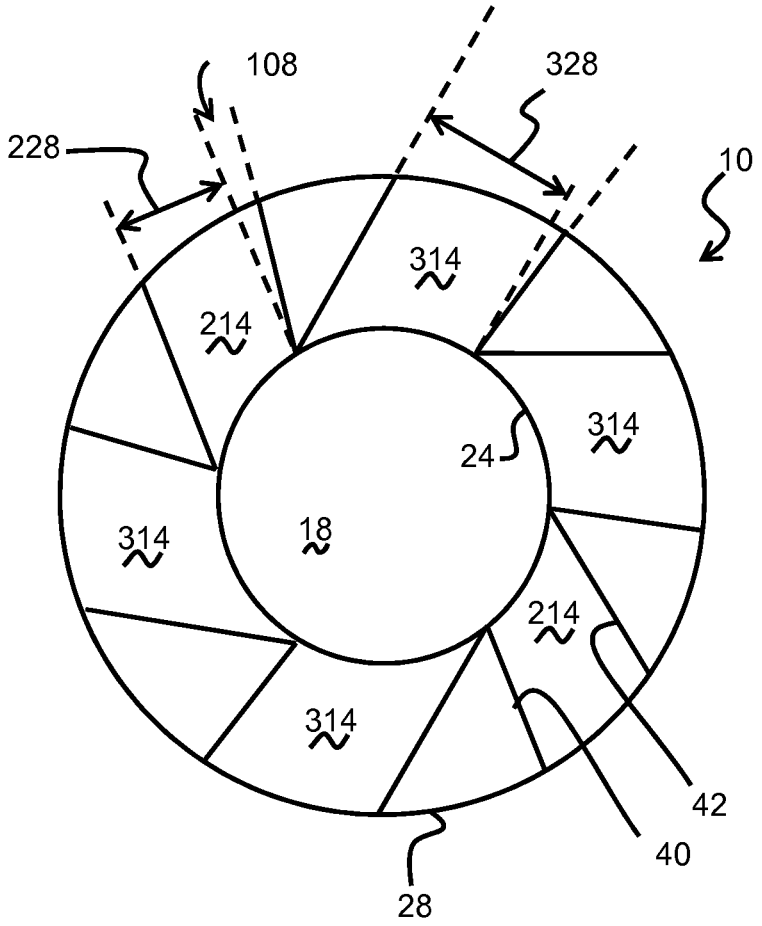
FIG. 12 shows a sectional view, along a horizontal plane, of an embodiment of a pour tube of the present invention.

FIG. 12 shows a sectional view, along section line A-A of FIG. 3, of a variant of the embodiment of a pour tube of the present invention shown in FIG. 3. Six exit ports (exit ports 214 having a port width 228, exit ports 314 having a port width 328) fluidly connect port distributor 18 to the outer surface 28 of pour tube 10. Each exit port 214, 314 in this embodiment has an inner exit port wall 40 and an outer exit port wall 42 partially defining the exit port. Outer exit port wall 42 has a greater length in the horizontal plane than does inner exit port wall 40. Each exit port 214, 314 in this embodiment has a flare 108; the cross-sectional area of each port at the extent 24 of the port distributor is smaller than the cross sectional area of the port at the outer surface 28 of the pour tube. This pour tube 10 is configured with two pairs of exit ports 314 with larger cross-section areas (larger exit ports 314) and one pair of exit ports 214 with smaller cross-section areas (smaller exit ports 214), the individual ports in each pair being disposed opposite each other around the horizontal circumference of the exterior of the device, equivalent to a position represented by 180 degrees of rotation around the longitudinal axis of the bore of the pour tube. Cross-section areas of the exit ports may be defined in a plane orthogonal to a longitudinal axis of an exit port.

Pour tubes of the present invention make use of one or more of a number of design elements:

1) There are at least two exit ports. Pour tubes according to the present invention may have three, four, five, six, or a greater number of exit ports.

2) The radial extent of the port distributor is greater than the radial extent of the bore.

$$r_{pd}>r_b$$

where $r_{pd}$ is the radial extent of the port distributor and $r_b$ is the radial extent of the bore.

3) The width of the port entrance for manufacturing or casting liquid metals is equal to, or greater than, 8 mm. The rotation angle around the periphery of the port distributor occupied by the port, expressed in radians, follows the mathematical relationship $$\text{theta} \geq 2\ \text{asin}(\sqrt{(8/(2r_{pd}))}),$$

where $r_{pd}$ is the port distributor radius expressed in millimeters and theta is the rotation angle around the periphery of the port distributor occupied by the port, expressed in radians.

4) The arc length from the inner port wall-port distributor intersection and outer port wall-port distributor intersection for a given port is equivalent to $r_{pd}$ multiplied by theta, and follows the relationship $$4\pi r_b > n r_{pd}(\text{theta}) > 1.3\pi r_b$$

where $r_b$ is the bore radius, n is the number of exit ports, $r_{pd}$ is the port distributor radius, and theta is the rotation angle around the periphery of the port distributor occupied by the port, expressed in radians.

5) The flare angle gamma between the inner port wall and the outer port wall of a port follows the relationship $$\pi/2 > \text{gamma} > 0$$

where gamma is expressed in radians.

6) The port height is expressed by the relationship $$3\pi r_b^2 > hna > 0.5\pi r_b^2,$$

where $r_b$ is the bore radius, h is the exit port height, n is the number of exit ports, and a is the width of the port entrance. In terms of absolute values, an embodiment of the invention makes use of exit ports having an exit port height equal to or greater than 8 mm to facilitate manufacturing of the pour tube of the invention, and to expedite liquid metal castability.

7) If there is to be no straight line, in the horizontal plane, passing from the vertical axis of the port distributor and through an exit port to the exterior of the pour tube, the angle theta around the periphery of the port distributor occupied by an exit port is expressed by the relationship $$\text{theta} < \arccos(r_{pd}/r_{ex})$$

or the pour tube is configured so that $$a < r_{pd}(r_{ex} - r_{pd})/r_{ex})$$

where a is the width of the port entrance, $r_{pd}$ is the port distributor radius and $r_{ex}$ is the pour tube radius in the horizontal plane of the port distributor. In terms of absolute values, an embodiment of the invention makes use of exit ports having an exit port width equal to or greater than 8 mm to facilitate manufacturing of the pour tube of the invention, and to expedite liquid metal castability.

8) Exit ports are externally unobstructed by other elements of the article of the invention; there is no portion of the article of the invention wherein the portion is disposed exterior to an exit port, and wherein the portion is intersected by an externally directed projection of a cross-section of the exit port.

9) At least one exit port has a cross-sectional area that is smaller than the cross-sectional area of another port. The cross sectional areas of the ports are measured, for this comparison, in a horizontal plane. In specific embodiments, the cross-sectional area of a smaller exit port is within a range from and including 0.1 to and including 0.9 of the cross-sectional area of a larger exit port, within a range from and including 0.2 to and including 0.8 of the cross-sectional area of a larger exit port, within a range from and including 0.3 to and including 0.7 of the cross-sectional area of a larger exit port, or within a range from and including 0.4 to and including 0.6 of the cross-sectional area of a larger exit port. Alternatively stated, the ratio of the cross-sectional area of a smaller exit port to the cross sectional area of a larger port may have a value within a range from and including 0.1 to and including 0.9, from and including 0.2 to and including 0.8, from and including 0.3 to and including 0.7, or from and including 0.4 to and including 0.6. In specific embodiments, the width in the horizontal plane of a smaller exit port is within a range from and including 0.5 to and including 0.9 of the width in the horizontal plane of a larger port, or within a range from and including 0.6 to and including 0.8 of the width in the horizontal plane of a larger port. Alternatively stated, the ratio of the width of a smaller exit port to the width of a larger port may have a value within a range from and including 0.5 to and including 0.9, or from and including 0.6 to and including 0.8. In specific embodiments, exit ports may be disposed so that pairs of exit ports having the same cross-sectional values are located opposite each other on the circumference of the article of the invention. In specific embodiments, the article of the invention may have six ports. In specific embodiments, the article of the invention may have four ports with a relatively larger cross-sectional areas, and two ports with relatively smaller cross-sectional areas. In specific embodiments, the article of the invention may have four ports with identical relatively larger widths, and two ports with identical relatively smaller widths.

In an example of an embodiment of the invention showing the relationships among geometrical factors, the pour tube has four ports (n=4). The bore radius $r_b$ is 20 mm, and the port distributor radius $r_{pd}$ is 25 mm. The minimum angle for theta is derived by the formula $$\text{theta}=2\ \text{asin}(\sqrt{(8/(2r_{pd}))})=2\ \text{asin}(\sqrt{(8/(2\times 25))})=47.1\ \text{degrees}$$

For four ports, the range of suitable arc lengths from the inner port wall-port distributor intersection and outer port wall-port distributor intersection for a given port is derived by $$4\pi(20)>4(25)(\text{theta})>1.3\pi(20)$$

$$144\ \text{degrees}>(\text{theta})>46.8\ \text{degrees}$$

In another illustrative example of an embodiment of the invention, the pour tube has four ports (n=4). The bore radius $r_b$ is 20 mm, and the port distributor radius $r_{pd}$ is 40 mm. The minimum angle for theta is derived by the formula $$\text{theta}=2\ \text{asin}(\sqrt{(8/(2r_{pd}))})=2\ \text{asin}(\sqrt{(8/(2\times 40))})=36.87\ \text{degrees}$$

For four ports, the range of suitable arc lengths from the inner port wall-port distributor intersection and outer port wall-port distributor intersection for a given port is derived by $$4\pi(20)>4(40)(\text{theta})>1.3\pi(20)$$

$$90\ \text{degrees}>(\text{theta})>26.7\ \text{degrees}$$

In particular embodiments of the invention, the radial extent of the port distributor and the radial extent of the bore differ by 2.5 mm, a value greater than 2.5 mm, 5 mm, or a value greater than 5 mm. In particular embodiments of the invention the radial extent of the port distributor is 25% greater, or at least 25% greater, than the radial extent of the bore.

The number of exit ports, the increased radial extent of the port distributor, the offset configuration of the outer wall of the exit port, the width of the port entrance, the arc length from the inner port wall-port distributor intersection and outer port wall-port distributor intersection for a given port, the flare angle of the port walls, the port height, and the absence of a straight line, in the horizontal plane, passing from the vertical axis of the port distributor and through an exit port to the exterior of the pour tube produce, singly or in combination, swirling of the fluid around an exit port axis as it flows outward through the exit port. The port geometry produces, with respect to prior art designs, a decrease in jet momentum of fluid passing through the exit ports. Consequently, if a pour tube of the present invention is placed in a mold, the strength of the jets coming in contact with the mold wall is decreased. This reduction in jet strength is observed in rectangular molds as well as in round molds. In addition, the pour tube of the present invention provides lower ratio of exit port velocity with respect to inlet velocity than do prior art pour tubes. In round and rectangular molds, a four-port pour tube of the present invention can produce a ratio of average port velocity over inlet velocity of 1.04, 1.03, 1.00 or less. In round and rectangular molds, a six-port pour tube of the present invention can produce a ratio of average port velocity over inlet velocity of 0.73 or less. Pour tubes of the present invention produce curved fluid paths both within and outside the exit port. Pour tubes of the present invention with four ports and six ports produce a swirling velocity that is uniform and evenly distributed.

Numerous modifications and variations of the present invention are possible. It is, therefore, to be understood that within the scope of the following claims, the invention may be practiced otherwise than as specifically described.

I claim:

1. A pour tube for use in casting a stream of molten metal from an upstream position to a downstream position, the pour tube having a pour tube central longitudinal axis and comprising an inner surface defining a bore and a port distributor in fluid communication, and an outer surface comprising a first pair of larger exit ports having a cross-sectional area and a horizontal width, and comprising a second pair of smaller exit ports having a cross-sectional area and a horizontal width, wherein the larger exit ports and the smaller exit ports are in fluid communication with the port distributor, wherein the port distributor is located downstream of the bore, wherein the port distributor has a greater radius with respect to the longitudinal axis than does the bore, wherein the larger exit ports have a cross-sectional area larger than the cross-sectional area of the smaller exit ports, wherein the exit ports comprise an inner wall and an outer wall, each in communication with the port distributor and the outer surface, and wherein the outer wall has a greater length than the inner wall, and wherein the exit ports have a configuration selected from the group consisting of (a) being spaced regularly at a rotation angle theta around the periphery of the port distributor, and wherein the exit ports have a port width of at least $$2r_{pd}\sin(\text{theta}/2)^2$$

wherein $r_{pd}$ is the port distributor radius and theta is the rotation angle around the periphery of the port distributor occupied by the port, expressed in radians: and (b) having a bore radius $r_b$ and a number of exit ports n so that $$4\pi r_b > n r_{pd}(\text{theta}) > 1.37\pi r_b.$$

2. The pour tube of claim 1, wherein each port has a straight central longitudinal axis, and wherein the exit port central longitudinal axes do not intersect the pour tube longitudinal axis.

3. The pour tube of claim 1, wherein each exit port of the pair of smaller exit ports is disposed in an opposite position, with respect to the other exit port of the pair, on the horizontal circumference of the exterior of the pour tube.

4. The pour tube of claim 1, further comprising a second pair of larger exit ports.

5. The pour tube of claim 4, wherein the individual exit ports in each pair of exit ports are disposed in opposite positions around the horizontal circumference of the pour tube.

6. The pour tube of claim 1, wherein the radius of the port distributor is less than twice the radius of the bore.

7. The pour tube of claim 1, wherein the exit ports are spaced regularly at a rotation angle theta around the periphery of the port distributor, and wherein the exit ports have a port width of at least $$2r_{pd}\sin(\text{theta}/2)^2$$

wherein $r_{pd}$ is the port distributor radius and theta is the rotation angle around the periphery of the port distributor occupied by the port, expressed in radians.

8. The pour tube of claim 1, wherein the exit ports are configured so that $$4\pi r_b > n r_{pd}(\text{theta}) > 1.3\pi r_b$$

wherein $r_b$ is the bore radius, n is the number of exit ports, $r_{pd}$ is the port distributor radius, and theta is the rotation angle around the periphery of the port distributor occupied by the port, expressed in radians.

9. The pour tube of claim 1, wherein the exit ports have a nonzero flare angle in the horizontal plane that is equal to or less than theta/2, wherein theta is the rotation angle around the periphery of the port distributor occupied by the port, expressed in radians.

10. The pour tube of claim 1, wherein the exit ports are configured so that $$3\pi r_b^2 > hna > 0.5\pi r_b^2$$

wherein $r_b$ is the bore radius, h is the exit port height, n is the number of exit ports, and a is the width of the port entrance.

11. The pour tube of claim 1, wherein the ratio of the cross-sectional area of a smaller exit port to the cross-sectional area of a larger port is within a range from and including 0.1 to and including 0.9.

12. The pour tube of claim 1, wherein the ratio of the cross-sectional area of a smaller exit port to the cross-sectional area of a larger port is within a range from and including 0.2 to and including 0.8.

13. The pour tube of claim 1, wherein the ratio of the cross-sectional area of a smaller exit port to the cross-sectional area of a larger port is within a range from and including 0.3 to and including 0.7.

14. The pour tube of claim 1, wherein the ratio of the cross-sectional area of a smaller exit port to the cross-sectional area of a larger port is within a range from and including 0.4 to and including 0.6.

15. The pour tube of claim 1, wherein the ratio of the width of a smaller exit port to the width of a larger port is within a range from and including 0.5 to and including 0.9.

16. The pour tube of claim 1, wherein the ratio of the width of a smaller exit port to the width of a larger port is within a range from and including 0.6 to and including 0.8.

* * * * *